US007748920B2

(12) United States Patent
Murray

(10) Patent No.: US 7,748,920 B2
(45) Date of Patent: Jul. 6, 2010

(54) MULTIPLE TUCKPOINTING TOOL AND METHOD DISCLOSURE

(76) Inventor: John W. Murray, 1402 S. 18th Ave., Maywood, IL (US) 60153

( * ) Notice: Subject to any disclaimer, the term of this patent is extended or adjusted under 35 U.S.C. 154(b) by 1039 days.

(21) Appl. No.: 11/183,487

(22) Filed: Jul. 18, 2005

(65) Prior Publication Data

US 2006/0016831 A1 Jan. 26, 2006

Related U.S. Application Data

(60) Provisional application No. 60/589,781, filed on Jul. 21, 2004.

(51) Int. Cl.
*B05C 17/005* (2006.01)

(52) U.S. Cl. ..... 401/11; 401/9; 401/265; 52/749.13

(58) Field of Classification Search ..... 52/DIG. 1, 52/749.1, 749.13; 156/71, 574, 579; 425/87; 222/389, 386.5, 386, 611.1; 401/9, 11, 265, 401/28

See application file for complete search history.

(56) References Cited

U.S. PATENT DOCUMENTS 3,108,313 A * 10/1963 Summers et al. ..... 401/6
3,162,328 A * 12/1964 Frume ..... 222/608
3,162,886 A * 12/1964 Wise ..... 118/208
3,768,939 A * 10/1973 Gramling ..... 425/87
3,830,678 A * 8/1974 Behunin ..... 156/349
4,043,487 A * 8/1977 Price ..... 222/166
4,135,651 A * 1/1979 Hession et al. ..... 222/611.2
4,311,258 A * 1/1982 Bradshaw ..... 222/391
5,017,113 A * 5/1991 Heaton et al. ..... 425/87
5,035,352 A * 7/1991 Mania ..... 222/611.2
5,046,642 A 9/1991 Cathcart, Sr. et al.
5,246,144 A 9/1993 Cathcart, Sr. et al.
5,277,511 A * 1/1994 Stockton ..... 401/261
5,314,100 A * 5/1994 Deaver ..... 222/626
5,681,125 A * 10/1997 Amaya ..... 401/146
5,749,498 A * 5/1998 Lavoie et al. ..... 222/192
5,865,555 A * 2/1999 Dawson ..... 401/266
5,882,133 A * 3/1999 Chao et al. ..... 401/266
D417,234 S * 11/1999 Ingram ..... D19/1
6,016,937 A * 1/2000 Clay ..... 222/330
6,170,221 B1 * 1/2001 Behunin ..... 52/745.1
6,227,813 B1 * 5/2001 Leimer ..... 417/234
6,450,723 B1 * 9/2002 Lithgow ..... 401/266
6,981,611 B2 * 1/2006 Carruth et al. ..... 222/1
2005/0183224 A1 * 8/2005 Bennett ..... 15/105.5
2006/0257573 A1 * 11/2006 Smythe ..... 427/355

FOREIGN PATENT DOCUMENTS

CA 1197391 A * 12/1985
FR 2388104 * 4/1977

* cited by examiner

*Primary Examiner*—Richard E Chilcot, Jr.
*Assistant Examiner*—Alp Akbasli
(74) *Attorney, Agent, or Firm*—Pyle & Piontek, LLC

(57) ABSTRACT

The present invention discloses an apparatus and method for applying two or more lines of mortar to lines of bricks to tuckpoint the same. The tool and method of the present invention comprises a mortar inlet which can be connected, via suitable length hose, to a mortar pump which can pump mortar under pressure to an inlet. The tool and method includes means for taking the supplied mortar and splitting or dividing it into two or more streams and further includes means for discharging the mortar to means for applying the mortar to the bricks.

14 Claims, 4 Drawing Sheets

MULTIPLE TUCKPOINTING TOOL AND METHOD DISCLOSURE

This is a United States Non-Provisional patent application and claims the benefit of the filing date of U.S. Provisional application, Ser. No. 60/589,781, filed Jul. 21, 2004.

This application is for an invention that relates to tuckpointing and an apparatus and methods for tuckpointing two or more lines of mortar on bricks at once.

BACKGROUND OF THE INVENTION

Heretofore it has been known to use a manual tool in the nature of a grease gun to apply a single line of mortar to a line of bricks of say a building. For example, see U.S. Pat. No. 5,046,642. This tool carries a limited amount of mortar and is carried by the operator, it being spring loaded to drive the mortar out of the tool. It is also known to pump mortar through a hose and apply it through a hand held tool applying a single line of mortar.

SUMMARY OF THE PRESENT INVENTION

The present invention is used in conjunction with a mortar pump, and comprises an apparatus and method for applying two or more lines of mortar to lines of bricks to tuckpoint the same. The tool and method of the present invention comprises a mortar inlet which can be connected, via suitable length hose, to a mortar pump which can pump mortar under pressure to an inlet. The tool and method includes means for taking the supplied mortar and splitting or dividing it into two or more streams and further includes means for discharging the mortar to means for applying the mortar to the bricks. Generally the tool must be handled by an operator, and the weight of the tool, the mortar therein, and the hose delivering the mortar, limits the size of the tool to a weight the operator can handle but can deliver two, three, four or five lines of mortar at once. Also the size of the pump used must be capable of delivering the amount of mortar being used by the tool. Generally the more lines of mortar being laid down at once, the greater the capacity of the pump needed to keep up the speed of application. Of course if the speed of application is slowed, the size of the pump could be reduced.

In order to apply the lines of mortar to the bricks, the means for diverting the mortar and the means for applying the mortar are sized or spaced to match the distance between the bricks being tuckpointed. For example, in horizontal lines of mortar, common sizes of spacing for bricks are about 3 inches, and on the vertical lines of mortar common sizes of spacing for bricks are about 8½ inches. Of course, brick of other sizes can be tuckpointed by making a tool to fit that size brick. Thus, a tool of the present invention could be built for any of these or other desired spacings. Alternatively, a tool could be constructed to be adjustable to accommodate two or more of these spacings for laying down two or more lines of mortar for tuckpointing at once. For example, you would construct a tool capable of laying down two, three, or four lines of mortar at once, by removing or adding diverting means and applying means and have the diverting and applying means adjustable in spacing. The limit generally is what physical size and weight tool the operator can comfortable and safely handle. It should be noted that often times the operator will be on a ladder, platform or scaffold so safety is of concern. Further, there is a physical limit to a larger tool size which could quickly fatigue an operator.

It should be noted that this tool is for tuckpointing, and only applies mortar. In some applications, such as on the less visible sides of brick buildings, applications alone by this tool is sufficient, and the mortar is sufficiently compacted by the use of this invention, that it need not be subsequently struck. If the mortar is subsequently to be struck, a separate operation is required.

However, in many buildings only the front has struck brick and the sides and rear do not. On such jobs, the tool of the present invention can easily cut time to half to one third of that previously required.

If multiple tools with different spacing, say one for vertical and another for horizontal lines, are used, the delivery hose and tools can be equipped with cooperating quick disconnects to facilitate making the change from say horizontal to vertical lines of mortar and/or spacing between lines.

DESCRIPTION OF THE PREFERRED EMBODIMENT

While the tool and method of the present invention can be constructed to apply two or more lines of mortar at once for tuckpointing, in this instance a three mortar line tool is shown. Of course, a four, five, or more line tool could also be built generally following the construction described here. If desired, the tool could be adjustable in both spacing between mortar lines and in the number of lines of mortar applied, as will be discussed below.

Figure 5:
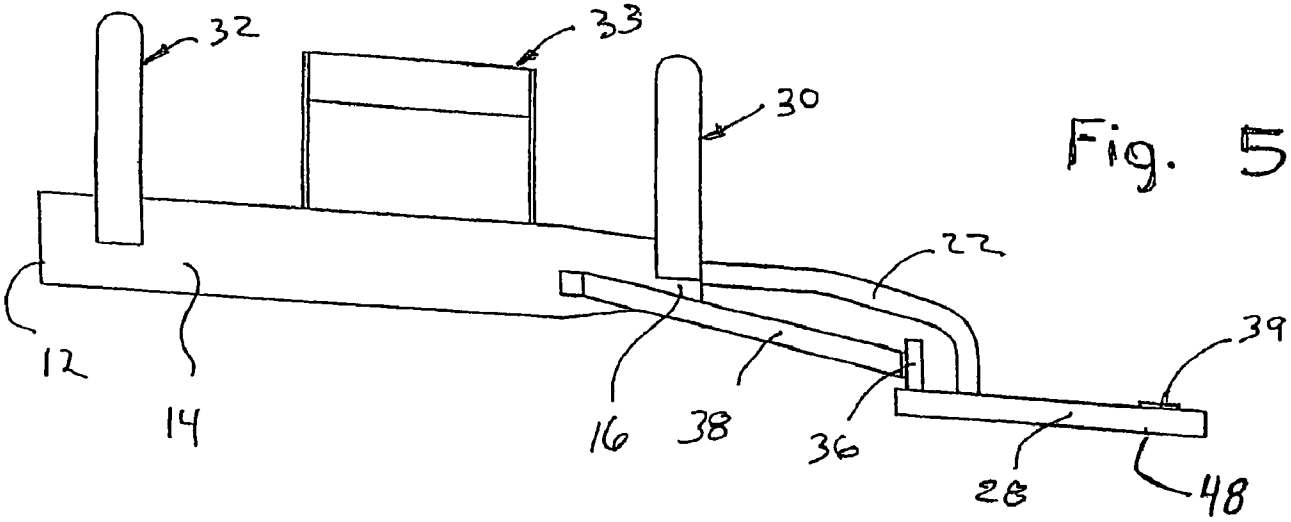
FIG. 5 is a right side elevation view of the tool shown in FIGS. 1-4.
Figure 6:
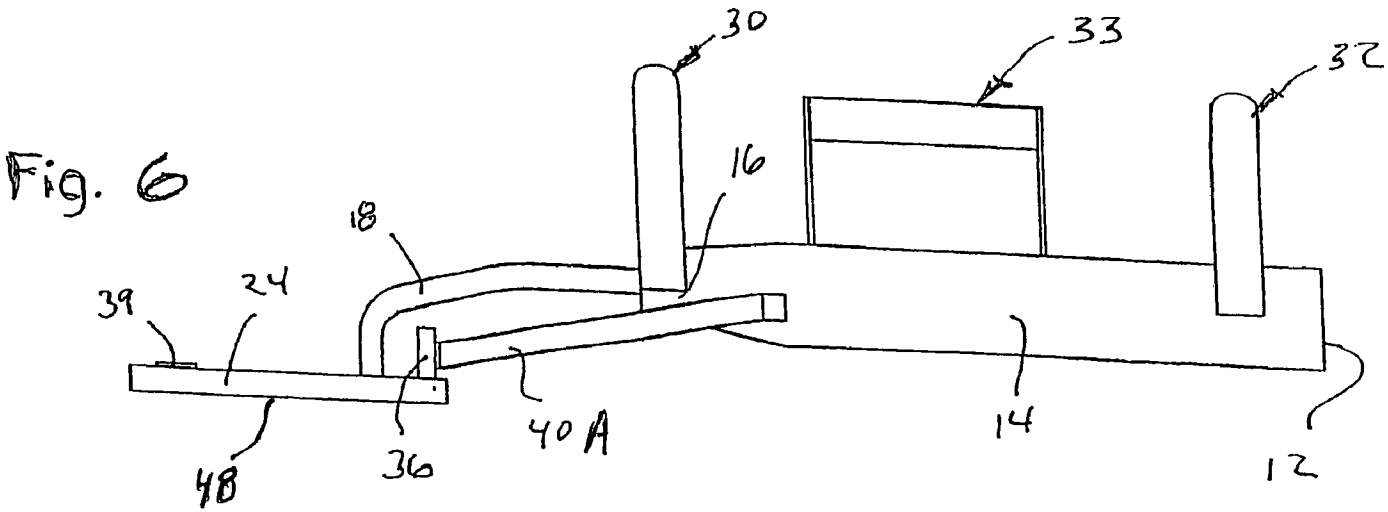
FIG. 6 is a left side elevation view of the tool shown in FIGS. 1-5.

In this instance the three-mortar line tool is given the reference number 10. It has an inlet 12, which can be fitted with various connections to connect to the mortar supply hose, such as threaded connections or quick disconnect for example. The inlet 12 supplies mortar to a large diameter, say about 3 inches to about 1 inch tube 14, with about 2 inches being preferred. From there the main tube 14 supplies mortar to a diverter section 16, which then splits or diverts the mortar into smaller streams, one for each line of mortar to be applied simultaneously to the bricks. In this instance, the diverter section has three smaller tubes 18, 20, and 22 to supply the three mortar lines. At one end, each line 18, 20, and 22 is connected to the diverter section 16 and at the other end to its respective applicator 24, 26, and 28. To assist the operator, the tool, and in this instance the main tube 14 and near the diverter section 16 are provided with suitable operator handles 30 and 32, respectively. In FIGS. 5 and 6, a third optional center handle 33 is shown and is between and at a right angle to the front and rear handles 30 and 32.

Additionally, bracing can be applied to the sides of the main tube 14 and to the rear of the applicators 24, 26, and 28, and in this instance is somewhat triangular having a front brace 36 and right and left side braces 38 and 40. A further brace 39 can be provided at the front of the applicators 24, 26, and 28.

Figure 3:
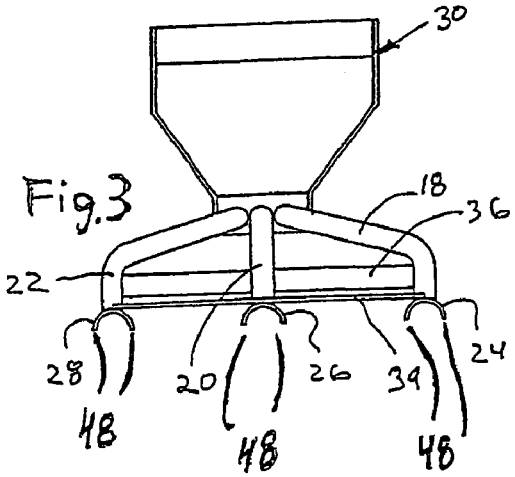
FIG. 3 is a front view of the tool shown in FIGS. 1 and 2.
Figure 4:
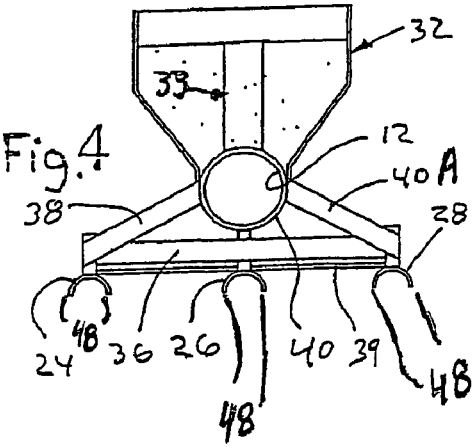
FIG. 4 is a rear view of the tool shown in FIGS. 1-3.

It is shown in FIGS. 3 and 4, the applicators are semicircular in cross sections so as to apply a semicircular cross section of mortar lines onto the bricks. As is shown in FIGS. 3, 5, and 6, the main tube changes cross section from circular at the inlet 12 to rectangular at the diverting section or end 16 to accommodate the three smaller tubes 18, 20, and 22.

Figure 1:
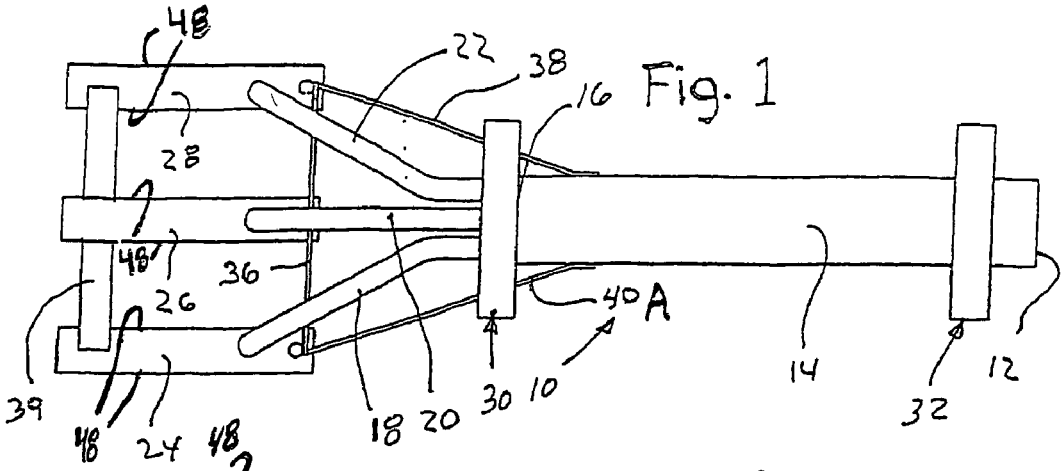
FIG. 1 is a top view of the apparatus of the present invention for carrying out the method of the present invention, in this instance for simultaneously for applying three lines of mortar at once for tuckpointing.
Figure 2:
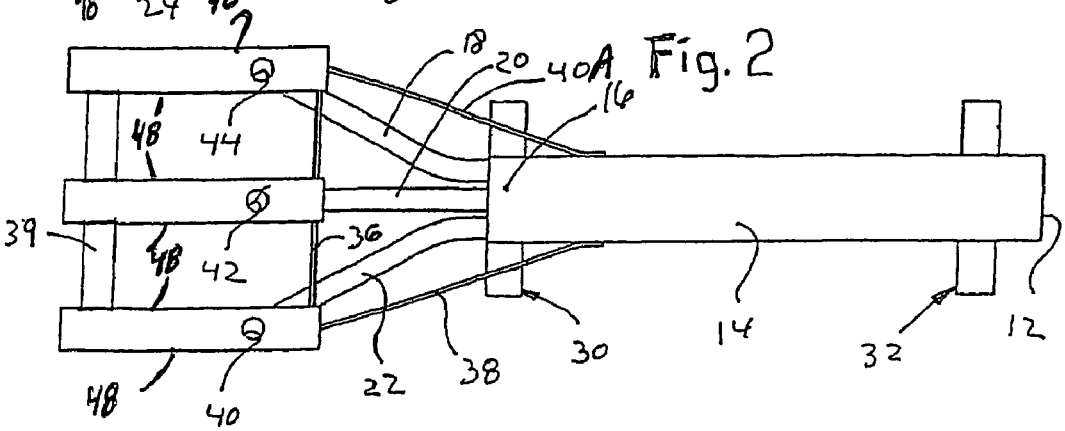
FIG. 2 is a bottom view of the tool shown in FIG. 1.

As is shown in FIG. 2, the line of mortar is discharged from tubes 18, 20, and 22 out of opening 40, 42, and 44 in the applicators 24, 26, and 28. It should be appreciated that the lower surfaces or edges 48 are generally held against the brick lines being tuckpointed and the tool moved along those lines with the mortar flowing into the tool inlet 12 and out the openings 40, 42, and 44 to fill the semicircular space of the applicator and to flow into the space between the lines of brick.

Figure 7:
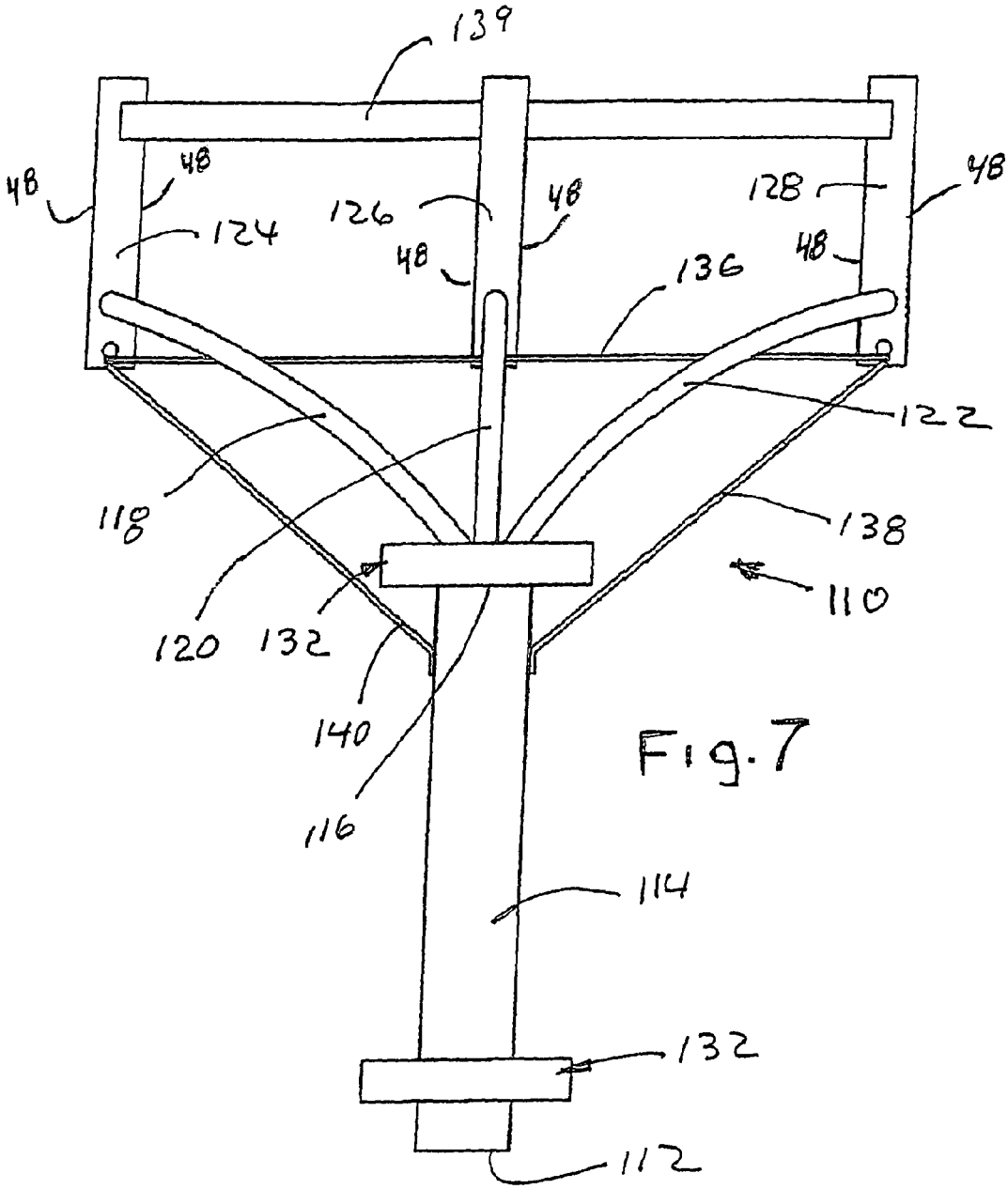
FIG. 7 is view similar to FIG. 1, but showing a second embodiment of the present invention capable of laying down three lines of mortar, spaced further apart for doing say vertical mortar lines of courses of brick.
Figure 8:
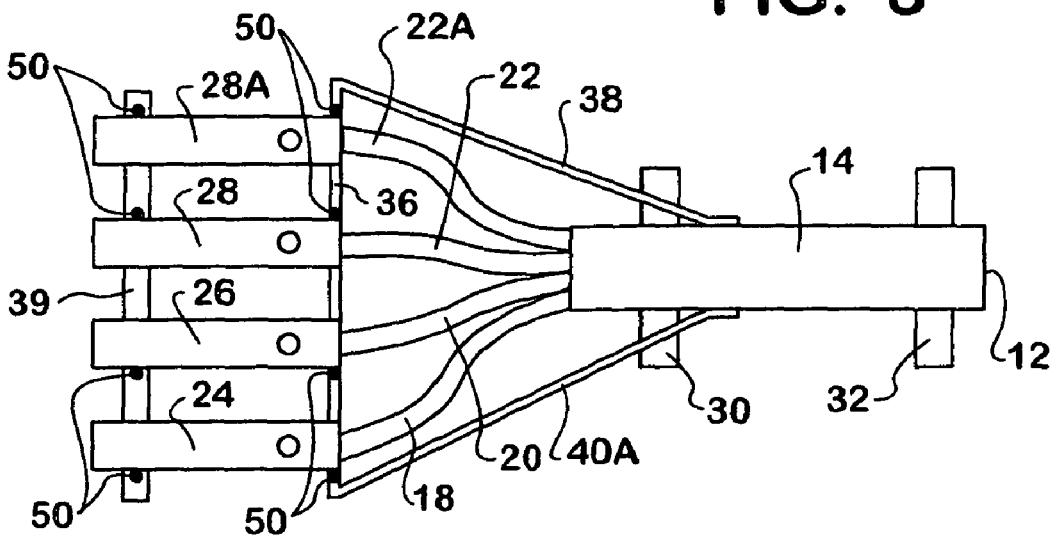
FIG. 8 is a schematic, similar to FIG. 2, but showing a tuckpointing tool with four applicators which are adjustable in spacing and held by adjustable means.
Figure 8A:
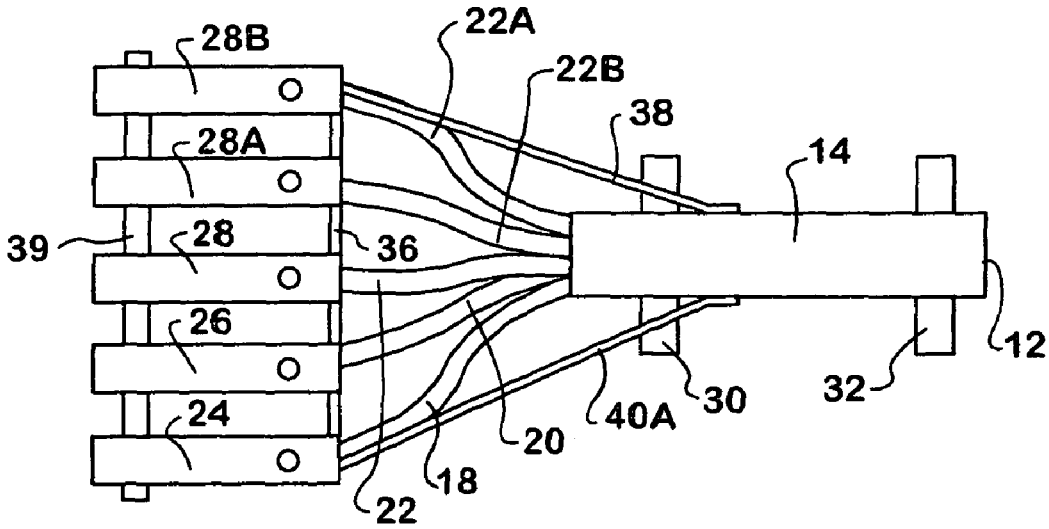
FIG. 8A is a schematic, similar to FIGS. 2 and 8, but showing a tuckpointing tool with five applicators.

As discussed above, the spacing between the applications of the tool can be fixed and then the tool changed when different spacing is needed, as say for horizontal or vertical lines of mortar. Referring to FIG. 7, another embodiment is shown with three towel portions for laying down three much more widely spaced lines of mortar, say for doing vertical lines of mortar between the ends of the brick. As the tool in FIG. 7 is similar to that shown in FIGS. 1-6, it is given similar reference numerals, except the number is 100 higher. That is, what was 10 in FIGS. 1-6, is 110 in FIG. 7. The spacing between the portions 124 and 126 or 126 and 128 is made to accommodate the length of layed brick and for example can be 3 inches or 8-½ inches on any other brick length dimension. Alternatively, the tool can be made adjustable (see FIG. 8) with hoses (18, 20, 22 and 22A) used instead of rigid tube for feeding the applicator from the main tube with appropriate adjustable or adjusting means 50 being provided to hold the applicators in position. FIG. 8A shows a tuckpointing tool with five applicators. As FIGS. 8 and 8A are similar to FIG. 2, except for the fourth (28A) or fifth (26) applicators and fourth (22A) or fifth (22B) tube or hoses, the same reference numerals are used. Of course one or more of the applicators could be made removable, along with its tube or hose, and its supply opening in the diverter section closed so that a single tool could vary the number of lines of mortar and/or the spacing or the lines of mortar being laid down.

The tool needs to resist the abrasion of the pumped mortar and must also be cleanable. The tool can be made of suitable, durable materials such as steel or preferably stainless steel. Stainless steel has the necessary abrasion resistance and can be readily cleaned with water without rusting. Where hose is used for an adjustable model, it can be flexible stainless steel hose on the outside and say Teflon lined rubber on the inside. The hoses can be readily replaced when they wear.

While the preferred embodiments of the apparatus and the method of the present invention have been disclosed and described, it should be understood the equivalent elements and equivalent steps could be provided and such would fall within the scope of the following claims.

What is claimed is:

1. A tuckpointing tool for applying multiple lines of tuckpointing mortar to already existing assembled courses of brick held together by existing mortar to tuckpoint said multiple courses of brick at once, comprising a mortar inlet capable of receiving mortar flow under pressure, means for diverting the mortar flow into at least two separate streams, means for applying mortar to brick, one for each separate stream, each of said means for applying, comprising an applicator having a convex tool side surface and a concave brick side surface, and a linear length adapted to extend along the brick, said convex and concave surfaces joined in outer edges adapted for riding on the outer surface of the brick, and said concave surface adapted for applying a convex line of additional tuckpointing mortar to the existing mortar of the existing courses of brick, said convex surface adapted for smoothing the additional tuckpointing mortar into the existing mortar and courses of brick, and means for delivering each of said separate streams to respective means for applying mortar to brick, whereby mortar can be delivered under pressure to said tuckpointing tool and mortar be applied in at least two separate mortar flows to apply more than one mortar flow simultaneously.

2. A tuckpointing tool as in claim 1, wherein said mortar inlet comprises one end of a larger cross section area tube, the other end of said larger diameter tube receiving smaller cross section tubes, one for each separate stream.

3. A tuckpointing tool as in claim 2, wherein said cross sectional area of said larger cross section area tube is at least about equal to the total cross sectional area of the smaller cross sectional area tubes.

4. A tuckpointing tool as in claim 2, wherein said one end of said larger tube is adapted to be connected to a high pressure pump for delivering mortar.

5. A tuckpointing tool as in claim 4, wherein said one end of said large tube is adapted to be connected to a high pressure hose connected to the high pressure pump.

6. A tuckpointing tool as in claim 5, wherein said tool is manually manipulable to tuckpoint at least two rows of bricks at the same time.

7. A tuckpointing tool as in claim 5, wherein said tool has means for diverting the mortar flow into at least three separate streams and said tool is manually manipulable to tuckpoint at least three rows of bricks at the same time.

8. A tuckpointing tool as in claim 1, wherein said tool has means for diverting the mortar flow into at least three separate streams and said tool is manually manipulable to tuckpoint at least three rows of bricks at the same time.

9. A tuckpointing tool as in claim 1, wherein the spacing between the means for applying mortar to brick comprises at least two applicator plates, the distance between the adjacent applicator plates being that of the spacing of one of the length and width of the brick being tuckpointed.

10. A tuckpointing tool of claim 9, wherein tool and said distance is adjustable for different brick widths and lengths.

11. A tuckpointing tool as in claim 1, wherein said large cross section area and small cross section area tubes are circular in cross section.

12. A tuckpointing tool as in claim 1, wherein at least three separate mortar flows and at least three applicator plates for applying mortar to at least three rows of brick at the same time, the spacing between the applicator plates being that of the spacing of one of the length and width of the at least three rows of brick.

13. A tuckpointing tool as in claim 12, wherein said tool is adjustable for brick rows of different length and width.

14. A tuckpointing tool as in claim 1, wherein there are four separate streams of mortar and said means for applying can apply four separate streams to tuckpoint four rows of brick at the same time.

* * * * *